US010287061B2

(12) United States Patent
Dierker et al.

(10) Patent No.: US 10,287,061 B2
(45) Date of Patent: May 14, 2019

(54) SHEET-MATERIAL CONTAINER FOR A DISPENSING UNIT AND METHOD FOR PRODUCING A SHEET-MATERIAL CONTAINER

(71) Applicant: Hilti Aktiengesellschaft, Schaan (LI)

(72) Inventors: Sascha Dierker, Merching (DE); Philip Poggendorf, Buchloe (DE)

(73) Assignee: Hilti Aktiengesellschaft, Schaan (LI)

( * ) Notice: Subject to any disclaimer, the term of this patent is extended or adjusted under 35 U.S.C. 154(b) by 744 days.

(21) Appl. No.: 14/434,969

(22) PCT Filed: Oct. 9, 2013

(86) PCT No.: PCT/EP2013/070989

§ 371 (c)(1),
(2) Date: Apr. 10, 2015

(87) PCT Pub. No.: WO2014/056952

PCT Pub. Date: Apr. 17, 2014

(65) Prior Publication Data

US 2015/0274373 A1 Oct. 1, 2015

(30) Foreign Application Priority Data

Oct. 11, 2012 (DE) ..... 10 2012 218 551

(51) Int. Cl.
*B05C 17/005* (2006.01)
*B65D 33/01* (2006.01)
(Continued)

(52) U.S. Cl.
CPC ..... *B65D 33/01* (2013.01); *B05C 17/00553* (2013.01); *B05C 17/00583* (2013.01);
(Continued)

(58) Field of Classification Search
CPC ..... B05C 17/00583; B05C 17/00586; B05C 17/00553; B65D 33/01; B65D 33/16;
(Continued)

(56) References Cited

U.S. PATENT DOCUMENTS 2,338,604 A * 1/1944 Silveyra ..... B65D 25/16 229/117.3
3,323,682 A * 6/1967 Creighton, Jr. ... B05C 17/00513 222/105
(Continued)

FOREIGN PATENT DOCUMENTS

CN 1509245 A 6/2004
DE 43 35 970 A1 4/1995
(Continued)

OTHER PUBLICATIONS

Chinese Office Action issued in Chinese counterpart application No. 201380058930.6 dated Mar. 28, 2016, with English translation (Seventeen (17) pages).
(Continued)

*Primary Examiner* — Patrick M. Buechner
(74) *Attorney, Agent, or Firm* — Crowell & Moring LLP

(57) ABSTRACT

A dispensing unit includes a first sheet-material bag which is filled with a first composition, a second sheet-material bag which is filled with a second composition, and a head part disposed on a first end of the first sheet-material bag and a second end of the second sheet-material bag. The head part has a first outlet channel for the first composition and a second outlet channel for the second composition, the first and second sheet-material bags are open on the first and second ends, and the first and second outlet channels are filled with the first and second compositions, respectively. A closure part is configured to couple with the head part, where the closure part is openable or removable by a user.

18 Claims, 2 Drawing Sheets

(51) Int. Cl.

| | |
|---|---|
| ***B65D 81/32*** | (2006.01) |
| ***B65D 83/00*** | (2006.01) |
| ***B65B 61/18*** | (2006.01) |
| ***B65B 69/00*** | (2006.01) |
| ***B65D 33/16*** | (2006.01) |

(52) U.S. Cl.
CPC ..... *B05C 17/00586* (2013.01); *B65B 61/186* (2013.01); *B65B 69/005* (2013.01); *B65D 33/16* (2013.01); *B65D 81/3233* (2013.01); *B65D 83/0055* (2013.01)

(58) Field of Classification Search
CPC ..... B65D 81/3233; B65D 83/0055; B65D 51/20; B65D 51/226; B65D 17/16; B65D 35/56; B65D 35/24; B65D 35/36; B65D 35/44; B65D 41/04; B67B 7/24; B67B 7/26; B67B 7/28
See application file for complete search history.

(56) References Cited

U.S. PATENT DOCUMENTS 3,738,535 A * 6/1973 Nicholls ..... A61M 5/31596 222/137
4,989,758 A * 2/1991 Keller ..... B05C 17/00506 222/137
5,332,122 A * 7/1994 Herold ..... B05C 17/00509 222/105
5,593,066 A * 1/1997 Konuma ..... B05C 17/00506 222/105
5,697,524 A * 12/1997 Sedlmeier ..... B01F 13/002 222/105
5,897,028 A * 4/1999 Sauer ..... B05C 17/00506 222/105
6,450,351 B1 * 9/2002 Thompson ..... B65D 1/04 215/6
6,786,330 B2 9/2004 Mollstam et al.
8,028,859 B2 * 10/2011 Paetow ..... B65D 81/3244 222/107
2005/0161454 A1 7/2005 Nehren et al.
2008/0187253 A1 * 8/2008 Willner ..... B05C 17/00553 383/37
2008/0251535 A1 10/2008 Suchan et al.
2009/0277926 A1 11/2009 Schell

FOREIGN PATENT DOCUMENTS

| | | |
|---|---|---|
| DE | 10 2007 018 143 B3 | 6/2008 |
| EP | 1 557 363 A1 | 7/2005 |
| EP | 2 116 482 A1 | 11/2009 |
| WO | WO 00/21653 A1 | 4/2000 |

OTHER PUBLICATIONS

PCT/EP2013/070989, International Search Report dated Jan. 24, 2014 (Three (3) pages).

* cited by examiner

SHEET-MATERIAL CONTAINER FOR A DISPENSING UNIT AND METHOD FOR PRODUCING A SHEET-MATERIAL CONTAINER

This application claims the priority of International Application No. PCT/EP2013/070989, filed Oct. 9, 2013, and German Patent Document No. 10 2012 218 551.8, filed Oct. 11, 2012, the disclosures of which are expressly incorporated by reference herein.

BACKGROUND AND SUMMARY OF THE INVENTION

The invention relates to a method for producing a sheet-material container for a dispensing unit. The invention also relates to a sheet-material container for a dispensing unit.

Multicomponent compositions, such as mortar, foam and sealing compositions, are made available to the user as multicomponent compositions in cartridges and sheet-material containers. Sheet-material containers usually contain a plurality of sheet-material bags, which are filled with the individual components of the multicomponent composition and are glued into a rigid head part. These have proven successful as packaging for such compositions and are characterized in particular by the small amount of material they contain, which must be discarded after dispensing the composition, in comparison with cartridges. Furthermore, sheet-material containers can be produced easily and inexpensively. A sheet-material container is inserted into a dispensing unit and the components of the composition are forced into outlet channels in the head part with the help of a dispensing mechanism. The individual components of the composition are mixed in a mixer to form the desired composition and then applied to an application site.

The sheet-material bags of the sheet-material container must be opened prior to the initial use. To do so, the user causes the sheet-material bags to rupture with the initial strokes of the dispensing operation. This "passive" opening can be supported by weak spots created in a targeted manner in certain locations on the sheet-material bags or appropriately placed piercing units.

DE 43 35 970 A1 discloses one example of such an opening aid. The end faces of the sheet-material bags are pressed onto spikes by the pressure applied by the dispensing unit so that the blades are oriented across the folds in the sheet-material bags.

A more complicated construction is proposed according to DE 10 2007 018 143 B3. Separate piercing tubes are inserted into the outlet connections of the caps attached to the ends of the sheet-material bags. The piercing tubes may be displaced out of a storage position, in which they are not in contact with the sheet-material bags, into an activation position by attaching a mixer such that in this position the piercing tubes penetrate through the films of the sheet-material bags or at least approximately come in contact with them.

All these approaches have the disadvantage that the outlet channels in the head part are not filled with the components of the composition prior to the initial use. This means that the user must first fill up the empty volume in the head part before the components of the composition will exit into the mixer. To synchronize the throughputs of the components of the composition in the case of multicomponent systems, the user is also required to perform a certain number of strokes before the actual application and to discard the quantities thereby conveyed.

Except for a deviation from the desired mixing ratio in the case of multicomponent systems, the air in the as yet unfilled regions in the head part can have a negative effect on the application or, because of the compressibility of air, there may be an unwanted pressure and flow behavior, which may then lead to disturbances in curing of the multicomponent composition. Another disadvantage of the known approaches with piercing units is the inadequate control over the opening processes. The piercing units do not always ensure satisfactory opening with a sufficiently large opening cross section, even when there has been proper handling by the user. This can also have a negative effect on the quality of the applied composition. In the case of multicomponent systems in particular, an opening that is too small may result in a mixing ratio that cannot be used.

The object of the invention is to create a sheet-material container that will permit immediate satisfactory discharge of the components of the composition when used in a dispensing unit.

The method according to the invention for producing a sheet-material container for a dispensing unit comprises the following steps:

applying a head part to a first end of a sheet-material bag filled with a composition wherein the head part has at least one outlet channel for the composition;

opening the sheet-material bag; and closing the outlet channel;

wherein the opening of the sheet-material bag and the closing of the outlet channel take place before the initial use of the sheet-material container in the dispensing unit.

The invention is based on the one hand on the finding that the disadvantages described in the introduction can all be overcome if the outlet channels of the head part are completely filled as much as possible with the components of the composition from the beginning. On the other hand, it has been recognized that the sheet-material bag of a sheet-material container need not necessarily be closed before the initial use. According to the invention, the sheet-material bag is intentionally already opened during the method of producing the sheet-material container. This makes it possible for the manufacturer to ensure openings of a sufficiently large size. The opening behavior need no longer be taken into account when selecting films. This yields new freedom in the choice of the packaging.

If a sheet-material bag is opened prematurely, this leads to the problem that the material components may come in contact with air. Furthermore, during storage or shipping of the sheet-material container, unwanted leakage of composition out of the head part is possible. These problems are solved according to the invention by closing the outlet channel already during production of the sheet-material container, i.e., before the initial use of the sheet-material container in the dispensing unit.

On the part of the user, the risks of uncontrolled rupture of the sheet-material bags and soiling are completely suppressed thanks to the present invention. The user need only remove and/or open the closure, for example by unscrewing a cap, and the sheet-material container is ready to use immediately.

The invention thus makes it possible to preserve the advantages offered by the tried and tested technology of filling a sheet-material bag in comparison with the use of hard cartridges and also to transfer certain advantages, which could previously be offered only by hard cartridges that are much more complicated to produce from a technical standpoint, to sheet-material bag systems.

The invention is aimed primarily at multicomponent systems, i.e., at sheet-material containers having a plurality of sheet-material bags, each being filled with one component of a multicomponent composition. However, the invention is fundamentally also applicable for a system having only one sheet-material bag.

According to a preferred embodiment of the production method according to the invention, the sheet-material bag is opened automatically in applying the head part, preferably by a piercing unit provided on the head part. Therefore, production of the sheet-material container is not delayed by the step of opening the sheet-material bag, because this step is performed simultaneously with the application of the head part.

To displace the air in the outlet channel, the outlet channel can be filled with a filling material in the production of the sheet-material container. The filling material can also ensure that the sheet-material bag, after being opened, will not lose too much of its original firm shape, because the component of the composition of the sheet-material bag cannot enter the outlet channel of the head part because of the filling material.

With a suitable choice of the filling material, it can be removed easily before the initial use. An embodiment in which the filling material is connected to a closure part (e.g., a cap) with which the outlet channel is closed is particularly advantageous here. When the closure part is removed by the user, the filling material is then also removed from the outlet channel at the same time.

An alternative embodiment of the production method according to the invention provides that, after opening the sheet-material bag, a portion of the composition is forced as filling material out of the sheet-material bag and into the outlet channel. This means that already in the production of the sheet-material container, the entire cavity of the head part can be filled with the components of the composition in advance, i.e., in preparation for the initial use, which only occurs later so that the user need not be concerned with this task, which is perceived as a nuisance.

According to a particular variant of this embodiment, the sheet-material bag is divided in the production of the sheet-material container, and the open second end of the sheet-material bag, which is formed when the bag is divided, is closed. In doing so, a pressure is applied to the composition in the sheet-material bag by the dividing action or the closing action, such that a portion of the composition is displaced out of the sheet-material bag and into the outlet channel. This variant advantageously allows simultaneous production of two sheet-material containers, starting from an elongated sheet-material bag for each component of the composition, which is initially closed on both ends. A head part is attached to both ends of the sheet-material bag, and the sheet-material bag is opened at both ends. Then the sheet-material bag is divided in the middle as described above, and the newly formed open ends of the two parts are closed. In doing so, the outlet channels are automatically filled with the component of the composition in the case of both sheet-material containers without necessitating any additional finishing step to do so.

Complete filling of the outlet channels according to the above principle can be achieved, for example, by sealing the second end of the sheet-material bag by means of a clip in the standard manner, the width of this clip being selected so that at least a quantity of composition corresponding to the volume of the outlet channel is displaced out of the sheet-material bag and into the outlet channel.

The invention also creates a sheet-material container for a dispensing unit with at least one sheet-material bag, which is filled with a composition, and with a head part, which accommodates one end of the sheet-material bag. The head part has at least one outlet channel for the composition. According to the invention, the sheet-material bag is opened at the first end, and the outlet channel is closed with a closure part, which can be opened or removed by a user.

The sheet-material container according to the invention is characterized in that the sheet-material bag is already opened before the first use, and the composition is prevented from coming in contact with air. Unwanted escape of the composition during storage or shipping of the sheet-material container is prevented by the closure part. With respect to the advantages of the sheet-material container according to the invention in comparison with the prior art, reference is made to the above discussion about the production method according to the invention.

As already explained above, the invention makes it possible to fill the outlet channel of the head part with a filling material, such that the filling material may be the same material as the composition in the sheet-material bag or it may be a different material such as a thermoplastic or elastomer material. In the latter case, the filling material may be attached to the closure part, so that it is automatically extracted from the outlet channel when the closure part is removed.

An attachable or screw-on cap, a valve flap or a seal, e.g., in the form of a welded film, is suitable in particular as the closure part.

With regard to a time-saving assembly of the sheet-material container according to the invention, the head part or the closure part has a piercing unit.

According to an advantageous refinement of this aspect, the piercing unit has an opening tube, which forms a part of the outlet channel for the composition and preferably has a slanted shape and/or sharp edges. The opening tube reliably ensures the creation of a defined opening of a sufficient size in the sheet-material bag.

Additional features and advantages of the invention are derived from the following description and from the accompanying drawings, to which reference is herewith made.

DETAILED DESCRIPTION OF THE DRAWINGS

Figure 1:
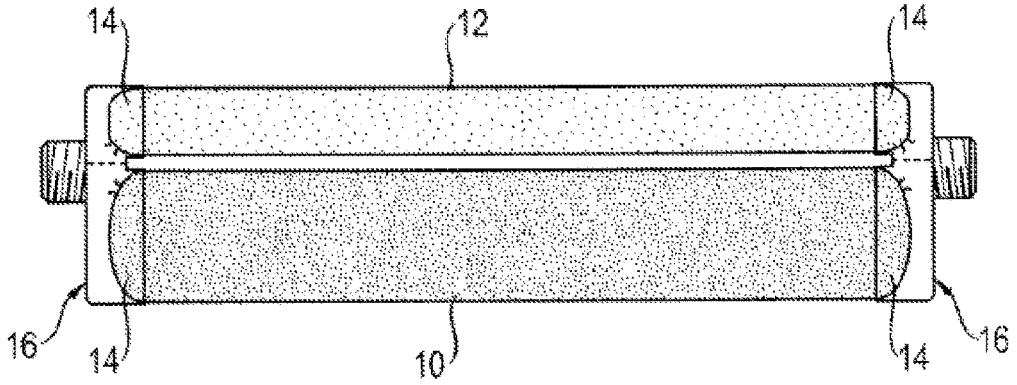
FIG. 1 illustrates a first step of a production method according to the invention.

FIG. 1 shows two essentially tubular sheet-material bags 10, 12, which are arranged in parallel with respect to their longitudinal axes, and each of which is filled with one component of a multicomponent composition. The length of each sheet-material bag 10, 12 is the same, but their diameters are coordinated with the preferred mixing ratio of the components of the composition.

A head part 16 is attached to each of the two opposite ends 14 of the sheet-material bags 10, 12, for example, by gluing. The head part 16 has a piercing unit for each sheet-material bag 10, 12 and has an outlet channel (not shown in FIGS. 1 to 3) through which the respective component of the composition can emerge.

Figure 2:
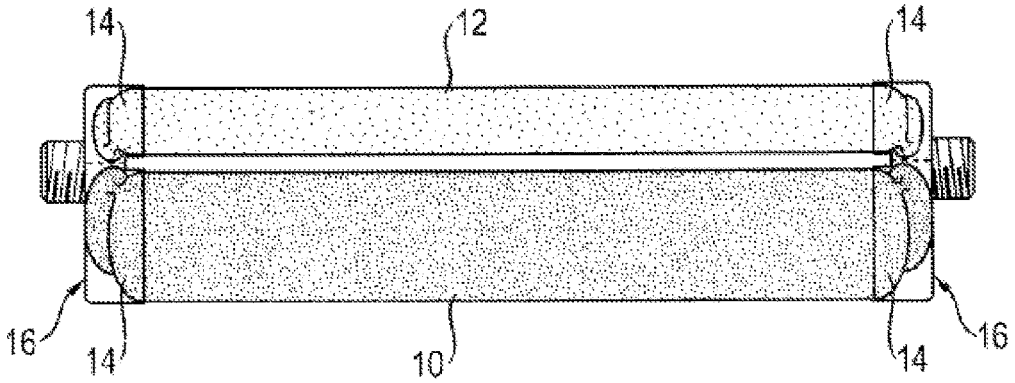
FIG. 2 illustrates a second step of the production method according to the invention.

The piercing units are arranged so that they automatically create an opening in the respective sheet-material bag 10, 12 when the head part 16 is applied. After opening the sheet-material bags 10, 12, some of the component of the composition that is in the bag can already escape into the respective outlet channel, as shown in FIG. 2. However, a significant portion of the outlet channels remain filled with air, regardless of the viscosity of the components of the composition.

The sheet-material bags 10, 12 are then divided at a location between their ends 14, preferably exactly at the center, e.g., by pinching the bag. The new ends 18 formed by dividing the sheet-material bags 10, 12 are closed in particular by a clip 20 or by welding or gluing. The ends 14 of the sheet-material bags 10, 12 accommodated in the head part 16 are hereinafter referred to as first ends and the newly formed ends 18 are referred to as second ends.

In dividing and/or closing, which may be done simultaneously, a pressure is exerted on the component of the composition at the second end 18 of the sheet-material bags 10, 12. This pressure results in a portion of the component of the composition in the sheet-material bag 10, 12 being displaced automatically into the outlet channel. If possible, all of the outlet channel should be filled with the component of the composition, so that the air in the outlet channel is displaced as thoroughly as possible. When the bag is closed with the clip 20, this is achieved through the choice of a clip having the corresponding minimum width.

Figure 3:
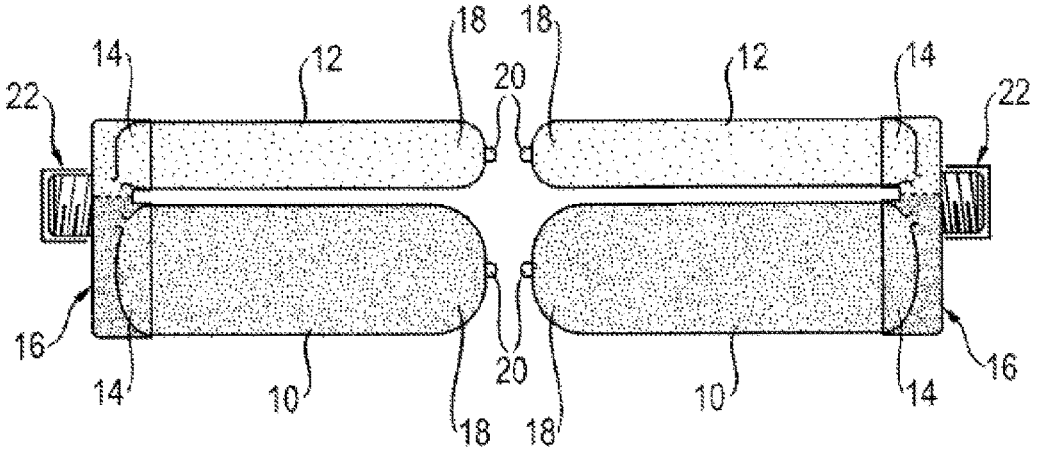
FIG. 3 illustrates a third step of the production method according to the invention.

After filling the outlet channel, it is closed tightly with a closure part 22 according to FIG. 3. The closure part 22 may be an attached or screw-on cap, a valve flap, a seal in the form of a welded film or the like. The closure part 22 effectively prevents contact of the mass components with air, which could reach the opened sheet-material bags 10, 12 through the outlet channels. This concludes the production of the sheet-material bag, i.e., the sheet-material container is in a storable and shippable condition.

Before using the sheet-material bag in a dispensing unit, one need only remove and/or open the closure part 22. The sheet-material container is then inserted into the dispensing unit, wherein a mixer is usually attached to the head part 16, in which the mass components emerging through the outlet channels are mixed during use of the dispensing unit. Since there is no air in the outlet channels before the initial use of the sheet-material container, the multicomponent composition is dispensed immediately and in the correct mixing ratio, so that there is no initial blank stroke and it is not necessary to discard any of the composition.

The air in the outlet channels can also be displaced in some other way in the production of the sheet-material container. For example, the outlet channels may be filled with the same material or with a different material, regardless of the emergence of the mass components out of the sheet-material bags 10, 12. In the latter case of filling the outlet channels with a different material, the filling material is discarded before the initial use. This may be done automatically if the filling material is attached to the closure part 22, which is removed anyway before the initial use. For example, prefabricated thermoplastic or elastomer materials are suitable for this purpose.

Figure 4:
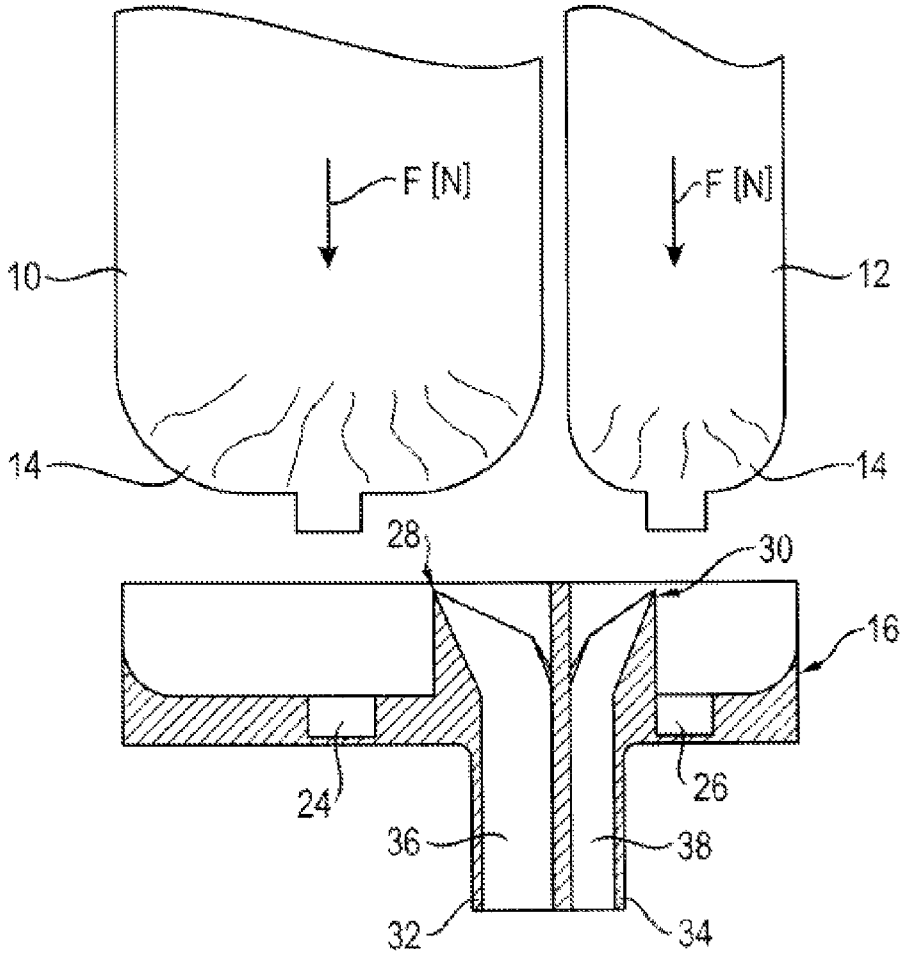
FIG. 4 is a sectional view of two sheet-material bags and a head part of a sheet-material container according to the invention in a first embodiment.

FIG. 4 shows one embodiment of the head part 16 in detail. In addition to two receptacles 24, 26 in which the first ends 14 of the sheet-material bags 10, 12 are secured, a piercing unit 28, 30 is provided for each sheet-material bag 10, 12. In the exemplary embodiment illustrated here, the piercing units are each designed as an opening tube 32, 34, which protrudes into the receptacle 24, 26 for the sheet-material bag 10, 12, and has a slanted shape with sharp edges. On attaching the sheet-material bags 10, 12 in the receptacles 24, 26, the force F, with which the sheet-material bags 10, 12 are pressed into the receptacles 24, 26 is sufficient for secure opening of the sheet-material bags 10, 12.

The opening tubes 32, 34 are at the same time part of the outlet channels 36, 38. In general, the entire space in the head part 16 should be understood to be the outlet channel 36, 38 into which the respective component of the composition can penetrate after opening the sheet-material bag 10, 12.

Figure 5:
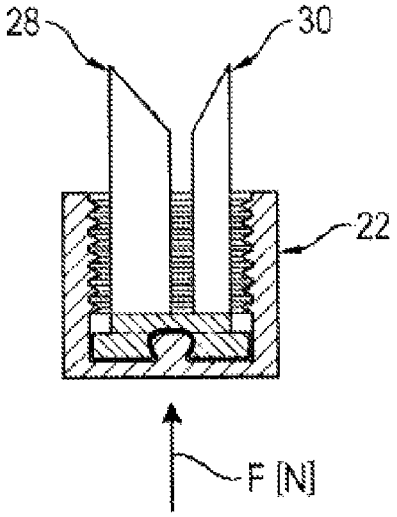
FIG. 5 is a sectional view of a closure for the head part of a sheet-material container according to the invention in a second embodiment.

FIG. 5 shows an alternative form of the piercing units 28, 30. The piercing units 28, 30 here are not formed in the head part 16 but instead in the closure part 22. The length of the piercing units 28, 30 is such that, after being completely attached to or screwed onto the head part 16, they protrude into the receptacles 24, 26 so far that the force F created by complete attachment and/or screwing the cap onto the head part acting on the sheet-material bag 10, 12 ensures reliable opening.

Regardless of where the piercing units 28, 30 are formed, other shapes are also available, for example, a slanted channel (with sharp blade), a slanted tube (single slant, roof-top slant), a slanted rod, a triangular, rectangular or polygonal blade edge, which may be designed to be either stiff or flexible.

LIST OF REFERENCE NUMERALS

10 sheet-material bag
12 sheet-material bag
14 first end
16 head part
18 second end
20 clip
22 closure part
24 receptacle
26 receptacle
28 piercing unit
30 piercing unit
32 opening tube
34 opening tube
36 outlet channel
38 outlet channel

The invention claimed is:

1. A dispensing unit, comprising:

a first sheet-material bag which is filled with a first composition;

a second sheet-material bag which is filled with a second composition;

a head part disposed on a first end of the first sheet-material bag and a second end of the second sheet-material bag, wherein the head part has a first outlet channel for the first composition and a second outlet channel for the second composition, wherein the first and second sheet-material bags are open on the first and second ends and wherein the first and second outlet channels are filled with the first and second compositions of the first and second sheet-material bags, respectively, prior to an initial use of the first and second sheet-material bags in the dispensing unit; and a closure part configured to couple with the head part, wherein the closure part is openable or removable by a user.

2. The dispensing unit according to claim 1, wherein the first and second compositions flow from the first and second sheet-material bags and into the first and second outlet channels, respectively.

3. The dispensing unit according to claim 1, wherein the first and second compositions are thermoplastic or elastomer.

4. The dispensing unit according to claim 1, wherein at least a portion of the first and second compositions contact the closure part.

5. The dispensing unit according to claim 1, wherein an end that is opposite the second end of the second sheet-material bag is closed with a clip or a glue or a weld.

6. The dispensing unit according to claim 1, wherein the removable closure part is an attachable or screw-on cap.

7. The dispensing unit according to claim 1, wherein the head part has a first piercing unit and wherein the first sheet-material bag is pierced when the head part is disposed on the first end of the first sheet-material bag.

8. The dispensing unit according to claim 1, wherein the first outlet channel is separate from the second outlet channel within the head part.

9. The dispensing unit according to claim 1, wherein the first composition is different from the second composition.

10. The dispensing unit according to claim 1, wherein the first and the second sheet-material bags are disposed parallel to each other.

11. The dispensing unit according to claim 1, wherein a first length of the first sheet-material bag and a second length of the second sheet-material bag are a same length.

12. The dispensing unit according to claim 1, wherein a first diameter of the first sheet-material bag is different than a second diameter of the second sheet-material bag.

13. The dispensing unit according to claim 12, wherein a difference between the first diameter and the second diameter is proportional to a mixing ratio of the first composition to the second composition.

14. The dispensing unit according to claim 7, wherein the first piercing unit has a first opening tube which forms a part of the first outlet channel and has a slanted shape and/or sharp edges.

15. The dispensing unit according to claim 7, wherein the head part has a second piercing unit and wherein the second sheet-material bag is pierced when the head part is disposed on the second end of the second sheet-material bag.

16. The dispensing unit according to claim 15, wherein the second piercing unit has a second opening tube which forms a part of the second outlet channel and has a slanted shape and/or sharp edges.

17. A method for producing a dispensing unit of claim 1, comprising the steps of:

applying the head part to the first and second ends of the first and second sheet-material bags;

opening the first and second sheet-material bags; and closing the first and second outlet channels;

wherein the steps of opening the first and second sheet-material bags and closing the first and second outlet channels occur prior to an initial use of the first and second sheet-material bags in the dispensing unit and wherein the first and second outlet channels are filled with the first and second compositions of the first and second sheet-material bags, respectively, prior to the initial use of the first and second sheet-material bags in the dispensing unit.

18. The method according to claim 17, wherein the step of opening the first and second sheet-material bags occurs automatically by a piercing unit on the head part when the head part is applied.

* * * * *